United States Patent [19]

Eeg et al.

[11] Patent Number: 4,815,631

[45] Date of Patent: Mar. 28, 1989

[54] BAG-IN-BOX PACKAGE

[75] Inventors: Edward G. Eeg, Racine; Daniel J. Grosse, Caledonia; Emer E. Schaefer, Racine, all of Wis.

[73] Assignee: S. C. Johnson & Son, Inc., Racine, Wis.

[21] Appl. No.: 166,280

[22] Filed: Mar. 10, 1988

[51] Int. Cl.[4] ..... B65D 5/40; B65D 5/70

[52] U.S. Cl. ..... 220/403; 220/462; 220/463; 222/183

[58] Field of Search ..... 220/403, 404, 462, 463; 222/183

[56] References Cited

U.S. PATENT DOCUMENTS

| | | | |
|---|---|---|---|
| D. 252,257 | 7/1979 | Dobbs et al. . | |
| 181,014 | 8/1876 | Scott . | |
| 1,331,409 | 2/1920 | Barnett . | |
| 2,954,901 | 10/1960 | Winstead . | |
| 3,054,549 | 4/1962 | Humphrey . | |
| 3,108,732 | 10/1963 | Curie et al. . | |
| 3,112,047 | 11/1963 | Weinreich et al. | 220/403 |
| 3,119,544 | 1/1964 | Cope et al. . | |
| 3,160,326 | 12/1964 | Sturdevant et al. . | |
| 3,173,579 | 3/1965 | Curie et al. . | |
| 3,363,807 | 1/1968 | Powell . | |
| 3,952,940 | 4/1976 | Malcolm | 220/462 |
| 4,174,051 | 11/1979 | Edwards et al. . | |

FOREIGN PATENT DOCUMENTS

| | | |
|---|---|---|
| 1465560 | 12/1966 | France . |
| 1565679 | 3/1969 | France . |

*Primary Examiner*—George T. Hall

[57] ABSTRACT

An improved bag-in-box container which has an opening in the front wall which functions both as a hand-hold and means to hold the pouring means. The container also has a second hand-hold on the rear wall positioned diagonally opposite the first opening.

1 Claim, 3 Drawing Sheets

BAG-IN-BOX PACKAGE

BACKGROUND AND FIELD OF INVENTION

The present invention relates to an improved disposable container for dispensing fluid materials and particularly to containers known as bag-in-box containers.

As is known in the art, bag-in-box containers have an outer protective shell, usually in the form of a box formed of corrugated board, paperboard or other inexpensive, yet stiff, material. An advantage of corrugated board or paperboard is that the package can be easily recycled. Contained within the protective shell is a flexible liner or bag which usually has a dispensing means, such as a spout, integrally attached and in communication with the interior of the liner. The liner or bag is protected by the protective shell and can contain any pourable fluid material that is compatible with the material used to form the liner. Typically the pouring means is licated within the protective box during shipping and can be exposed by opening the box, often by means of a punch out in one wall of the box that can be removed.

For small packages, the bag-in-box concept works quite well. However, for large size containers, the weight and bulk of the package make pouring and handling difficult. There have been numerous proposals for providing handles and hand-holds to these larger bag-in-box containers. However, these prior designs have numerous disadvantages, including manufacturing difficulty, cost and difficulty of consumer use.

SUMMARY OF INVENTION AND ADVANTAGES

We have found that an improved bag-in-box coatainer can be provided which overcomes the above disadvantages by providing a combined opening for the pouring means of the inner bag and a hand-hold in the front wall of the box and also providing an opening for a hand-hold in the box wall opposite the front wall. The second hand-hold should be diagonally opposite the first opening and both openings should be in the bottom half of their respective walls.

DESCRIPTION OF THE PREFERRED EMBODIMENTS

Figure 1:
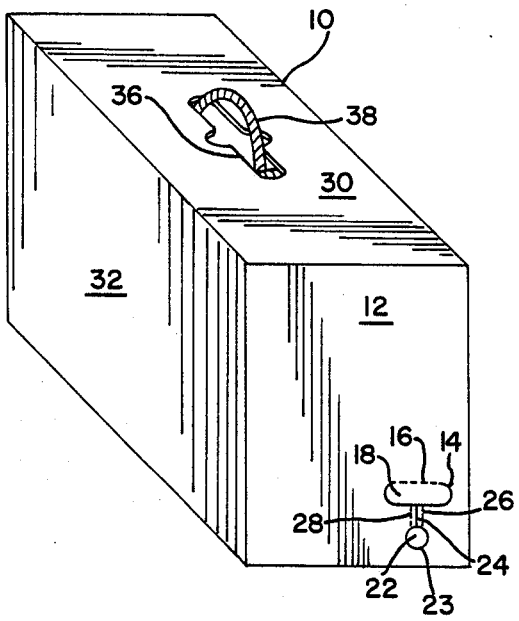
FIG. 1 is a front perspective view of the closed and sealed container of the present invention.
Figure 2:
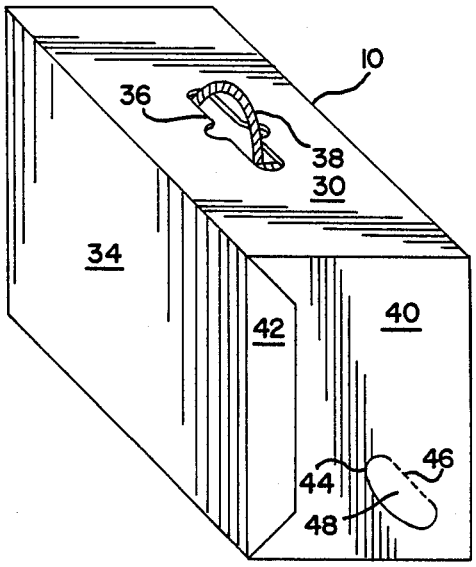
FIG. 2 is a rear perspective view of the closed and sealed container of the present invention.
Figure 4:
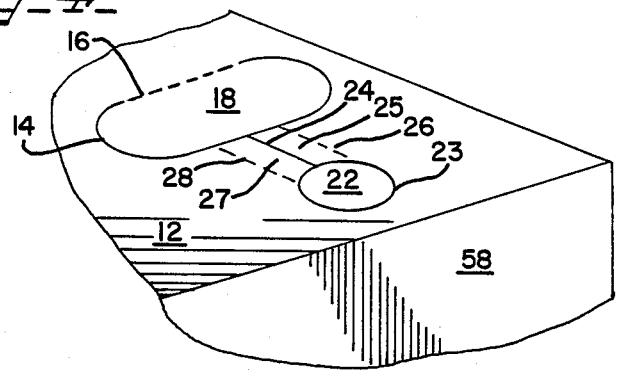
FIG. 4 is an enlarged partial view of the lower corner of the front wall of the box in the closed and sealed position.
Figure 6:
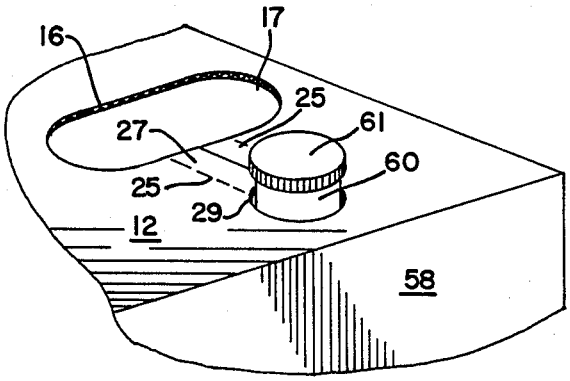
FIG. 6 is an enlarged partial view of the lower corner of the front wall of the box showing the opening of the hand-hold means and the pouring means in the final position for dispensing.

In the preferred embodiment as shown in the drawings, FIGS. 1 and 2 show box 10 having front wall 12, top wall 30, side walls 32 and 34, rear wall 40 and a bottom wall, not shown. As shown in FIG. 4, front wall 12 has hand-hold opening 17 which will be formed by punching in hand-hold flap 18 along cut line 14 and bending the flap backwards into the interior of the container along score line 16. This forms an opening 17, as shown in FIGS. 6 and 7, to be used as a hand-hold and also to retrieve pouring means 60 from the interior of the container. The means to hold pouring means 60 include punchout 22 formed by cut line 23 and flaps 25 and 27 formed by cut line 24 and score lines 26 and 28. Punchout 22 forms an opening 29 sized to firmly hold pouring means 60.

Rear wall 40 has formed in the lower corner diagonally opposite opening 17, a second hand-hold formed by bending hand-hold flap 48 into the interior of the container along score line 46 by punching in flap 48 along cut line 44. Box flap 42 is shown in FIG. 2 in the exterior of box 10. Flap 42 is used to reinforce the construction of box 10 and can either be glued to the exterior or interior of rear wall 40. Box 10 is optionally provided with a conventional carry handle 38 which protrudes through opening 36 in top 30.

Box 10 can be formed from any conventional material conventionally used for forming bag-in-box type containers. These materials include paperboard, carrigated board and the like. A particularly preferred material is three-wall corrigated board. This provides strength to box 10 while not adding much weight to the container.

Figure 3:
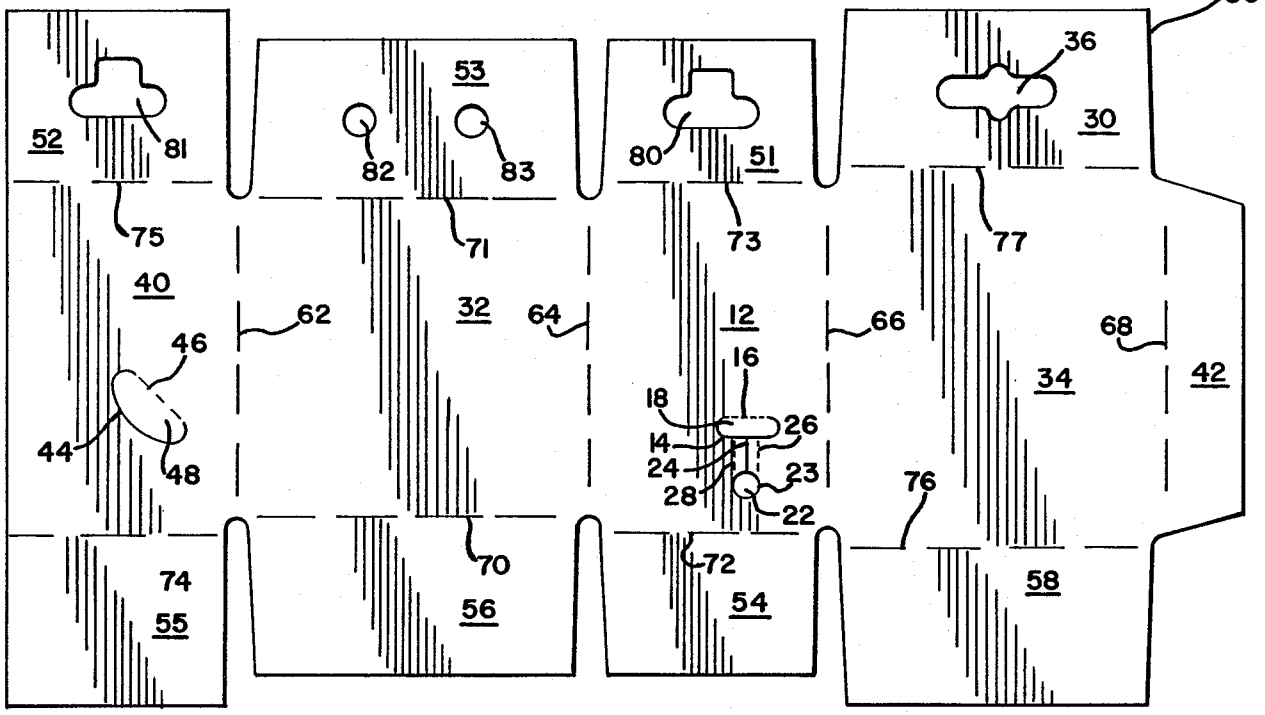
FIG. 3 is a plan view of a blank used in forming the box of the container of the present invention.

Box 10 is formed form a box blank 50 as schematically shown in FIG. 3. Blank 50 show the arrangement of the openings, cut lines and score lines used to form box 10. The surfaces, openings, cut lines and score lines of box 10 described above are identified by the same reference numbers in FIG. 3. Additionally blank 50 shows front top flap 51, rear top flap 53, inside top flap 53, bottom 58, front bottom flap 54, rear bottom flap 55 and inside bottom flap 56. Box 10 is constructed in a conventional manner by forming the box shape by folding blank 50 on score lines 62, 64, 66 and 68. Flap 42 is then glued in a conventional manner to rear wall 40, either on the exterior or interior of the box.

Next, the top of box 10 is formed by first folding inside top flap 53 along score line 71 into the interior of the box shape. Front top flap 51 and rear top flap 52 are then folded along score lines 73 and 75 respectively. Typically, front and rear top flaps 51 and 52 are sized so that these flaps cover the entire surface of inside top flap 53. Flaps 51 and 52 may optionally be glued to flap 53 for added strength. Lastly, top 30 is folded on score line 77 and glued to flaps 51 and 52. As shown in FIG. 3, top 30, and top flaps 51, 52 and 53 have openings 36, 80, 81 82 and 83 which are placed to enable handle 38 to be attached to box 10 in a conventional manner.

The bottom of box 10 is formed in a similar manner by folding along score lines 70, 72, 74 and 76 after the liner containing the pouring means is placed withing the box. Typically, the liner will be filled with product before it is placed in box 10, although it may be possible to fill the liner with product after the liner is placed inside box 10 and before the bottom is sealed.

Figure 5:
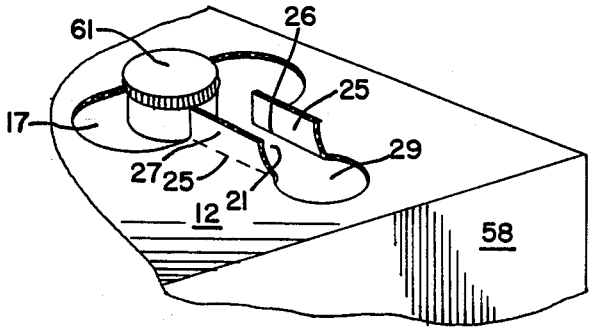
FIG. 5 is an enlarged partial view of the lower corner of the front wall of the box showing the opening of the hand-hold means and the exposure of the pouring means which is not yet in the final position.

The operation and opening of the container of the present invention is shown in more detail in FIGS. 4, 5, and 6. Hand-hold flapa 18 is punched into the interior of box 10 by pressure along cut line 14 to fold flap 18 inward along score line 16. This forms hand-hold opening 17 as shown in FIG. 5. Pouring means 60 can then be retrieved from the interior of box 10 through hand-hold opening 17. Also flaps 25 and 27 are opened by bending the flaps upwardly along score lines 26 and 28 respectively. This forms passageway 21 between openings 29 and 17. Pouring means 60 is moved through passageway 21 to opening 29 and flaps 25 and 27 are returned to their original positions, or as close to their original positions as possible. Opening 29 and flaps 25 and 27 hold pouring means 60 in place for dispensing.

Pouring means 60 will include a suitable closure 61 which can be secured by any conventional means including screw threads, and the like. Also other conventional closure means for pouring means 60 can be used.

The container is used to dispense materials in the following manner. Closure 61 is removed from pouring means 60 while pouring means 60 is in an upright position. One hand is placed through opening 17 and the container is lifted. The other hand of the person using the container is placedin the opening in rear wall 40 formed by flap 48. The container can then be easily tilted to dispense the product contained within the container. By placing the hand-holds in the position as illustrated, the user has good leverage to control the amount of product dispensed.

The invention of the present invention has been described by means of the above preferred embodiment. The invention is only limited, however, by the following claims.

What we claim is:

1. A disposable dispensing container for dispensing fluid materials comprising a box enclosing a flexible collapsible bag, the box having a flat front wall, a flat rear wall on the side of the box opposite the flat front wall, and the bag having a pouring means adjacent to the front wall, the improvement comprising the front wall having an opening to receive the pouring means, the opening being positioned in the front wall to also provide a first hand-hold, means for securing the pouring means in position in the opening in the front wall and an opening in the rear wall positioned to provide a second hand-hold, the second hand-hold being positiond diagonally opposite the first hand-hold and located in the bottom half of the rear wall.

* * * * *